United States Patent [19]

Omodeo Zorini

[11] Patent Number: 4,683,727

[45] Date of Patent: Aug. 4, 1987

[54] THREAD GUIDE RAIL FOR CROCHET GALLOON MACHINES

[75] Inventor: Luigi Omodeo Zorini, Cilavegna, Italy

[73] Assignee: Comez S.p.A., Cilavegna, Italy

[21] Appl. No.: 937,380

[22] Filed: Dec. 3, 1986

[30] Foreign Application Priority Data

Mar. 7, 1986 [IT] Italy ..... 21154/86[U]

[51] Int. Cl.[4] ..... D04B 23/00

[52] U.S. Cl. ..... 66/207; 66/214

[58] Field of Search ..... 66/203, 204, 207, 84, 66/85, 214, 125 R

[56] References Cited

U.S. PATENT DOCUMENTS

| | | | |
|---|---|---|---|
| 3,369,375 | 2/1968 | Shepard | 66/214 |
| 3,895,503 | 7/1975 | Kohl | 66/214 |
| 4,368,626 | 1/1983 | Menegatto | 66/207 |
| 4,448,047 | 5/1984 | Romano | 66/207 |
| 4,553,412 | 11/1985 | Odham | 66/207 |

OTHER PUBLICATIONS

Reisfeld, "Warp Knitting Engineering", New York, National Knitted Outwear Ass., 1966, pp. 166–168.

*Primary Examiner*—Henry S. Jaudon

*Attorney, Agent, or Firm*—Laff, Whitesel, Conte & Saret

[57] ABSTRACT

Thread guide rail for crochet galloon machines exhibiting a rectangular cross section 2 on the major base of which is obtained an inclined flat 3 provided with a longitudinal groove 4 extending over the whole length of the rail. The rail, on the surface opposite said inclined flat, comprises two series of opposite transverse grooves *7a, 8a* disposed in alignment with each other and between which a central recessed portion 9 is defined which extends longitudinally over the whole length of the rail. The rail can be associated with a number of thread guide elements 10, exhibiting each a rectilinear portion 12 adapted to engage into two aligned transverse grooves, followed by a U-shaped portion 11 engageable on either side of the rail through the engagement of a fitting projection 14 provided thereon, into the longitudinal groove 14. Seen in section the transverse grooves exhibit a profile adapted to mate with that of the corresponding section of the rectilinear portion.

3 Claims, 3 Drawing Figures

THREAD GUIDE RAIL FOR CROCHET GALLOON MACHINES

FIELD AND BACKGROUND OF THE INVENTION

The present invention pertains to a thread guide rail for crochet galloon machines.

It is known that crochet galloon machines consist of a number of cooperating members adapted to create a fabric. In more detail, a needle bar is provided carrying a plurality of needles directed according to a common horizontal plane. The needle bar, controlled by suitable devices, is provided with a reciprocable movement in the extent direction of the needles which are slidably supported by a needle-row parallel to the needle bar and substantially act so as to interlock the warp yarns with the weft yarns. Warp yarns are fed by eye-pointed needles carried by a guide bar facing the needles and directed parallelly to the needle bar. The eye-pointed needles are operated in synchronism with the needles and according to horizontal and vertical combined movements giving each eye-pointed needle a trajectory extending astride of the corresponding needle. Weft yarns are fed to the needles by threading tubes connected each to a free end of a thread guide element in turn engaged with a thread guide rail. The latter extends parallelly to and above the needle bar, so that it exhibits the threading tubes in the region of the needles themselves. Furthermore, the thread guide rail is subjected to horizontal and vertical combined movements giving each threading tube a trajectory extending astride of a corresponding needle, similarly to what said about the eye-pointed needles.

The object of the present invention is to provide a new type of thread guide rail as those currently used have proved not to be quite suitable to operate at the high operating speeds required by modern crochet galloon machines.

In this connection it is to be noted that thread guide rails currently used exhibit a substantially rectangular section on the major base of which is located an upwardly inclined flat provided with a groove extending longitudinally to the rail itself. The face opposite that having the inclined flat is provided with a series of transverse grooves disposed side by side and extending transversely to the thread guide rail over the whole width thereof.

Each thread guide element is rigidly engageable to the thread guide rail in the region of a U-shaped elastic portion thereof which, by forced fitting, can be located over and on either side of the rail itself and which exhibits a fitting projection snap-entering the longitudinal groove.

In addition, each thread guide element exhibits, after the elastic U-shaped portion, a rectilinear portion carrying a tube at its free end and housed, over a short length thereof, along one of the transverse grooves against which it is pressed by the spring action of the U-shaped portion.

The drawbacks proper to the thread guide rails of known type consist in that they are not capable of supporting the thread guide elements connected thereto in the best manner when high operating speeds are reached.

In greater detail, the thread guide elements tend to take incorrect positionings relative to the thread guide rail due to the sudden reversals of motion transmitted to the same by the rail itself. In fact the free length of said rectilinear portion, owing to the inertia thereof, is subjected to important deformations and "flag-wavings" during the motion reversals. Furthermore, said flag-wavings often cause the rectilinear portion to disengage from the respective transverse grooves, which results in an undesirable positioning in space of the same.

The disengagement possibility between the rectilinear portion and the respective housing is remarkably increased by the fact that the transverse grooves have a continuous linear extension. As a result, the thrust actions of the rectilinear portions of said thread guide elments, due to the spring actions of the respective U-shaped portions are unevenly distributed all over the transverse grooves; this inconvenience is further increased by the unavoidable structure faults exhibited by the respective contact surfaces.

If most of the action exerted by the U-shaped portion discharges close to the upper end of the thread guide rail, which often occurs, the engagement efficiency between the rectilinear portion and the corresponding transverse groove is remarkably reduced. Practically, the rectilinear portion only engages with a restricted groove length. As a consequence, the length of the rectilinear portion susceptible to deformations due to flag-waving increases and, as a result said deformations become more frequent.

The efficient engagement between the rectilinear portions and the respective transverse grooves is further restricted by the fact that the transverse grooves seen in section exhibit a triangular outline while the rectilinear portions of the thread guide elements exhibit, in the regions of their engagement with said grooves, a substantially rectangular section with rounded edges.

Due to the above discussed drawbacks known rails must be used at relatively low operating speeds, as an accidental disengagement of one single thread guide element from the respective groove would bring about serious complications in the machine operation.

OBJECTS

Under this situation the general object of the present invention is to devise a thread guide rail allowing to obviate the drawbacks present in known thread guide rails.

A further object of the invention is to devise a guide rail that does not remarkably depart from the construction and operation principles of known rails, so that it can readily be adapted to any existing crochet galloon machine without requiring important modifications thereon.

SUMMARY OF THE INVENTION

The foregoing and further objects that will become more apparent from the description which follows are substantially attained by a thread guide rail for crochet galloon machines, of the type having a rectangular cross section on the major base of which is obtained an inclined flat provided with a longitudinal groove extending over the whole length of the rail itself and comprising a plurality of transverse grooves disposed side by side on the surface opposite said inclined flat, a plurality of thread guide elements being engageable with said thread guide rail, each of said elements exhibiting a rectilinear portion followed by a U-shaped portion provided, at the free end thereof, with a fitting projection and said thread guide element being adapted to be coupled to the thread guide rail by the engagement of said fitting projection into said longitudinal groove as well as of said rectilinear portion into one of said transverse grooves, wherein said thread guide rail comprises two series of said opposite transverse grooves disposed in alignment with each other and between which a central recessed portion is defined which extends longitudinally over the whole length of said thread guide rail, said grooves exhibiting, in section, a profile mating with the profile of the corresponding section of said rectilinear portion.

BRIEF DESCRIPTION OF THE DRAWINGS

Further features and advantages will become more apparent from the detailed description of a preferred embodiment of a thread guide rail for crochet galloon machines given hereinafter by way of non-limiting example with reference to the accompanying drawings, in which.

DESCRIPTION OF THE PREFERRED EMBODIMENT

Figure 2:
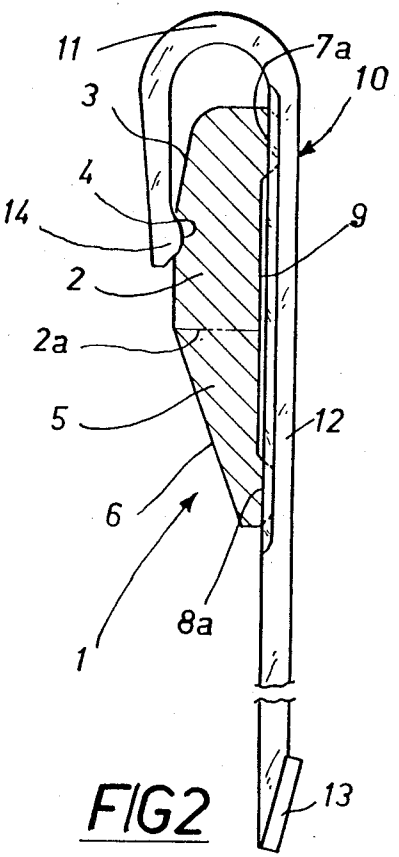
FIG. 2 is a sectional view taken along the line II—II in FIG. 1.

Referring to the drawings, a thread guide rail for crochet gallonn machines according to the present invention has been globally identified by reference numeral 1.

As shown in FIG. 2, the rail 1 comprises a first portion 2 having a substantially rectangular section (ideally defined, for the sake of clearness, by the broken line 2*a*), on the major base of which is obtained an inclined flat 3. Said flat is provided with a longitudinal groove 4 extending in a longitudinal direction over the whole length of the thread guide rail 1. Following the first portion 2 there is a second support portion 5 of one piece construction with the first one and extending at a lower position relative to the longitudinal groove 4; said second portion has an inclined downwardly-tapering surface 6 also obtained at a lower position relative to the groove 4.

In an original manner, on the face opposite the groove 4 a first series 7 of transverse grooves 7*a* and a second series 8 of transverse grooves 8*a* are obtained. Advantageously, it is provided that the first series 7 of transverse grooves 7*a* is disposed at the upper end of the thread guide rail 1, whereas the second series 8 of transverse grooves 8*a* is disposed at the free end of the support portion 5.

Between said first 7 and second 8 series there is an intermediate recessed portion 9 extending longitudinally over the whole length of the thread guide rail 1 and exhibiting a transverse extension longer than the sum of lengths of a transverse groove 7*a* and a transverse groove 8*a*.

The transverse grooves 7*a* and 8*a* are opposed to each other and in alignment so that they are fit for the engagement of a number of thread guide elements, one of which, identified by reference numeral 10, is shown in the drawings in engagement with the thread guide rail 1.

As is possible to see, the thread guide element 10 essentially comprises an elastic U-shaped portion 11 after which there is a rectilinear portion 12 carrying at its free end a threading tube 13 fastened thereto. The thread guide element 10 is engageable to the thread guide rail 1 through the forced fitting of the elastic portion 11 on either side of the upper end of the thread guide rail 1 itself. A steady positioning can be ensured by the snap-engagement of a fitting projection 14 carried by the free end of the elastic portion 11 into the longitudinal groove 4.

Under this situation, the rectilinear portion 12 is engaged within two aligned grooves 7*a* and 8*a* and urged against the same by the spring action exerted by the elastic portion 11.

Figure 3:
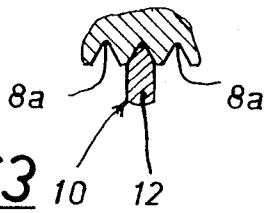
FIG. 3 is a sectional view taken along the line III—III in FIG. 1.
Figure 1:
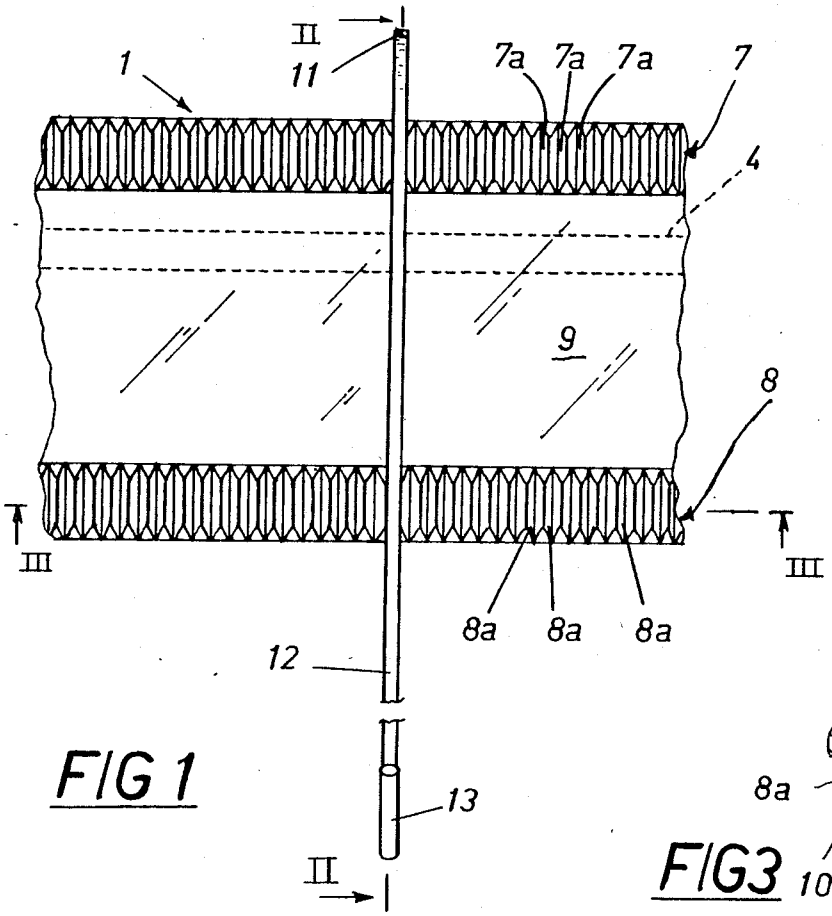
FIG. 1 is an interrupted front view of a thread guide rail according to the invention, on which a thread guide element is mounted.

Advantageously, according to a further feature of the present invention, it is provided that grooves 7*a* and 8*a* seen in cross section exhibit a profile adapted to mate with the profile of the corresponding section of the rectilinear portion 12, as shown in FIG. 3. As clearly visibile in said figure, it has been advantageously provided that both the grooves 7*a* and 8*a* and the rectilinear portion 12 have a substantially triangular cross section in the region of their mutual contact surfaces.

After the above description mainly done as regards structure, the thread guide rail in reference does not need further explanations.

The invention achieves the proposed objects.

In fact it is possible to note that the thread guide rail in question is adapted to prevent any flag-wavings on the part of the rectilinear portions of the thread guide elements associated therewith, as well as to hinder any accidental disengagement of the same from the respective grooves.

This is due firstly to the fact that each rectilinear portion 12 is engaged to the thread guide rail at two points (transverse grooves 7*a* and 8*a*) spaced apart an important length from each other, so that the free length in the rectilinear portion 12 appears considerably reduced in relation to the free length exhibited by the thread guide elments mounted on traditional thread guide rails.

Secondly, the restricted extension of the transverse grooves 7*a* and 8*a* as compared to the width of rail 1, causes each rectilinear portion 12 to be held in two well-determined bearing points, instead of along a continuous length, which occurred in known thread guide rails. As a result, the thread guide rail-thread guide element assembly constitutes a system of forces of the isostatic type, consisting of three forces disposed at the vertices of an ideal triangle. In greater detail, the action exerted by the elastic portion 11 causes the presence, on the thread guide rail 1, of a force acting on the longitudinal groove 4 against the action of two other forces applied to the transverse grooves 7*a* and 8*a* respectively. It will be recognized that under this situation it is easy to calculate the amount of the forces acting on the thread guide rail 1. Said forces, unlike what happened in the case of known thread guide rails (which, together with the respective thread guide elements constituted systems of statically indeterminable forces) will always and anyway have a well-determined point of application.

In other words, tbe thread guide rail in reference is envisaged and shaped so that a system of forces and torque reactions may be generated on each rectilinear portion 12 in the region of the transverse grooves 7*a* and 8*a* which is capable of giving rise to a corresponding resultant torque the points of application of which will be closer to the free end of the rectilinear portion itself than in the thread guide rails of known type.

In addition and advantageously, the disengagement of the rectilinear portions 12 from the respective grooves 7*a* and 8*a* is made still more difficult due to the conjugated profiles thereof in the region of the contact surfaces of the same.

Obviously, many modifications and variations may be made to the thread guide rail as devised without departing from the scope of the inventive idea characterizing it.

What is claimed is:

1. A thread guide rail for crochet galloon machines, of the type having a rectangular cross section on the major base of which is obtained an inclined flat provided with a longitudinal groove extending over the whole length of the rail itself and comprising a plurality of transverse grooves disposed side by side on the surface opposite said inclined flat, a plurality of thread guide elements being engageable with said thread guide rail, each of said elements exhibiting a rectilinear portion followed by a U-shaped portion provided, at the free end thereof, with a fitting projection and said thread guide element being adapted to be coupled to the thread guide rail by the engagement of said fitting projection into said longitudinal groove as well as of said rectilinear portion into one of said transverse grooves, wherein said thread guide rail comprises two series of said transverse opposite grooves disposed in alignment with each other and between which a central recessed portion is defined which extends longitudinally over the whole length of said thread guide rail, said grooves exhibiting, in cross-section, a profile mating with the profile of the corresponding section of said rectilinear portion.

2. The thread guide rail as claimed in claim 1, further comprising a tapered support portion extending below said longitudinal groove and provided, at the free end thereof, with one of said series of transverse grooves.

3. The thread guide rail as claimed in claim 1, wherein said central recessed portion has a transverse extension longer than the sum of the lengths of each pair of opposed transverse grooves.

* * * * *